United States Patent [19]

Schneider et al.

[11] Patent Number: 4,656,920

[45] Date of Patent: Apr. 14, 1987

[54] METHOD AND APPARATUS FOR DYNAMICALLY SUPPORTING A HIGH STRESS STRUCTURE

[75] Inventors: Horst Schneider, Arget; Joachim Hermann, Duernhaar, both of Fed. Rep. of Germany

[73] Assignee: Messerschmitt-Boelkow-Blohm Gesellschaft mit beschraenkter Haftung, Munich, ; DEX

[21] Appl. No.: 820,956

[22] Filed: Jan. 21, 1986

Related U.S. Application Data

[62] Division of Ser. No. 627,346, Jul. 2, 1984, Pat. No. 4,607,560.

[30] Foreign Application Priority Data

Aug. 17, 1983 [DE] Fed. Rep. of Germany ..... 3329672

[51] Int. Cl.[4] ..... F41F 17/08

[52] U.S. Cl. ..... 89/16; 89/1.3

[58] Field of Search ..... 89/1.3, 1.7, 1.701, 89/1.702, 1.703, 1.704, 1.705, 1.706, 8, 16, 31; 60/255, 634, 914; 102/289, 373, 434, 503

[56] References Cited

U.S. PATENT DOCUMENTS

| | | | |
|---|---|---|---|
| 84,525 | 12/1868 | Abbruzzo | 89/16 |
| 339,885 | 4/1886 | Hill | 89/16 |
| 652,742 | 7/1900 | Bernstein | 89/31 |
| 1,661,091 | 2/1928 | Riabouchinski | 89/8 |
| 3,731,628 | 5/1973 | Fink | 60/255 |

FOREIGN PATENT DOCUMENTS

| | | | |
|---|---|---|---|
| 1578052 | 8/1975 | Fed. Rep. of Germany . | |
| 502439 | 5/1920 | France | 89/16 |
| 490182 | 8/1938 | United Kingdom | 89/16 |

*Primary Examiner*—Stephen C. Bentley

*Attorney, Agent, or Firm*—W. G. Fasse; D. H. Kane, Jr.

[57] ABSTRACT

Structures subject to a high operational stress, such as weapon launchers, combustion chambers, artillery barrels and the like, are strengthened dynamically by a counter-pressure generated simultaneously with the load causing the operational stress. The counter-pressure causes a dynamic stress which is effective temporarily to counteract the operational stress. In a weapons launcher, for example, the operational stress occurs in a launching tubular member and the counteracting stress occurs simultaneously in a second tubular member surrounding the first launching tubular member.

2 Claims, 3 Drawing Figures

METHOD AND APPARATUS FOR DYNAMICALLY SUPPORTING A HIGH STRESS STRUCTURE

This is a divisional of application Ser. No. 627,346 filed July 2, 1984, now U.S. Pat. No. 4,607,560.

FIELD OF THE INVENTION

The invention relates to a method and apparatus for dynamically supporting a high stress structure, such as weapons launching tubes, combustion chambers, artillery barrels, and the like. Conventionally, such high stress structures have been provided with features producing a static counter stress condition which counteracts at least partially the operational stress or load to which the structure is exposed under operating conditions.

DESCRIPTION OF THE PRIOR ART

It is known to reduce stress to which the material of mechanical structures is exposed under high operating loads, by the application of suitable static counter stresses or by producing an inherent or so-called "eigen"-stress in the material of the particular structural component. The "eigen"-stress is supposed to counteract any operational stress to which the component may be exposed. Especially tubular members or containers which are exposed to high internal pressures, for example tubular members for launching grenade type weapons or rockets, and ammunition containers, may be exposed to such high internal operational stresses at least temporarily. In such devices it is known to produce a counteracting static "eigen"-stress by so-called autofrettage or by winding external layers around the tubular member or by shrinking hoops around the tubular member. These prior art methods, however, require that the "eigen"-stress state or condition is always applied prior to the occurrence of the operational load which causes the high stress condition. Besides, the counter biasing or "eigen"-stress must be maintained for the useful life of the structural component. Such substantially permanent maintenance of the "eigen"-stress or counter stress has the disadvantage that relaxation characteristics cannot be avoided.

German Patent Publication (DE-AS) No. 1,578,052 discloses a weapon equipped with a hermetically sealed charging space filled with a powder type propellant charge. In this prior art weapon the closing means for the charging space are so dimensioned that the explosion of the charge generates a compression peak which exceeds the elastic stress limit of the material forming the charging space. However, the compression peak is of such a short duration that a permanent deformation of the weapon is avoided. This type of protection is not generally applicable because the size of the "eigen"- or biasing stress which is to oppose the temporary operational stress or load, is either limited by the static material strength of the material of which the structural component is made, or it is necessary to take into account the conditions caused by the shape of the structural component.

OBJECTS OF THE INVENTION

In view of the above it is the aim of the invention to achieve the following objects singly or in combination:

to provide a method and apparatus which will avoid the above outlined difficulties of the prior art by avoiding a prestressing altogether, and also avoiding a permanent biassing of the respective structural component, whereby relaxation problems and problems with the dimensional stability and shape stability of the structural components are also obviated;

to provide a method and apparatus which is universally applicable in the mentioned environment so that supporting means or tubular members for the protection of high pressure tubular members may be standardized;

to apply the protective, dynamic supporting stress or pressure simultaneously with the occurrence of the high pressure inside the structural component;

to provide a method and apparatus which will not be dependent in its effectiveness on the shape of the tubular member to be protected;

to enable the use of even larger operational compression loads than have been possible heretofore; and to make sure that the operating load or stress and the counteracting support or protective stress start simultaneously and that they have the same or substantially the same characteristic relative to time.

SUMMARY OF THE INVENTION

According to the invention there is provided a method for dynamically supporting a high stress structure by subjecting the high stress structure to a high operating stress inside the structure and simultaneously subjecting the high stress structure on the outside thereof to a protective dynamic supporting stress which coincides with and at least partially counteracts the operating stress. Both stresses are terminated substantially simultaneously, namely when the operating stress ceases.

The apparatus according to the invention is so constructed that external structural components are arranged for cooperation with the structural component which is exposed to the high stress in such a way that the simultaneous application of the counterstress or load is assured. More specifically, according to the invention a first tubular member forming the high stress structural component is surrounded by at least one second tubular member for enclosing a space around the first tubular member. Means, such as an explosive charge for generating an operating stress inside the first tubular member are located inside the first tubular member. Second means, such as further explosive charges, or means for diverting a portion of the explosive force of a propellant charge are provided for simultaneously causing a protective dynamic supporting stress inside the space around the first tubular member for at least partially counteracting the operating stress.

BRIEF FIGURE DESCRIPTION

In order that the invention may be clearly understood, it will now be described, by way of example, with reference to the accompanying drawings, wherein:

FIG. 1 shows a sectional view through one embodiment according to the invention, illustrating the rear end portion of a launching tube for a weapon, such as a rocket or the like;

DETAILED DESCRIPTION OF PREFERRED EXAMPLE EMBODIMENTS AND OF THE BEST MODE OF THE INVENTION

Figure 1:
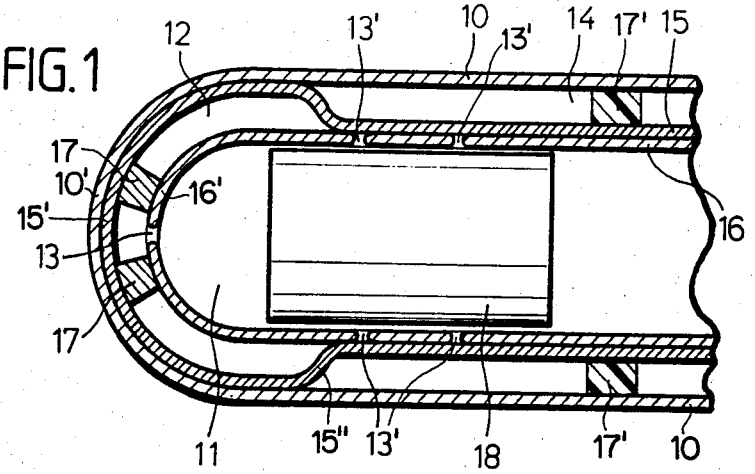

FIG. 1 shows one embodiment of an apparatus for performing the present method. The sectional view of FIG. 1 illustrates the rear end of a rocket launcher comprising a first launching tubular member 16 operatively supported inside a second tubular member 10 by rigid spacers 17 interposed between the bottom 16' of the first tubular member 16 and the bottom 10' of the second tubular member 10. The rigid spacers 17 permit the transmission of any recoil force from the bottom 16' to the bottom 10'. Second spacers 17' of compressible material such as hard foam or the like, are operatively inserted between the first tubular member 16 and the second outer tubular member 10. If desired, the space 14 between the tubular members may be completely filled by the compressible spacer material. The interior space 11 near the bottom 16' of the inner tubular member 16 communicates with the space 12 between the two bottoms 16' and 10' through at least one throttle opening 13 in the bottom 16'. The spacers 17 have relatively narrow dimensions so that communication is not blocked by these spacer members 17. A weapon 18 such as a projectile or rocket or the like is located inside the inner tubular member 16 for expulsion out of the tubular member. Additional throttle openings 13' are located in the side walls of the inner tubular member 16 along the length of the tubular member 16.

When the weapon 18 is launched from the tubular member 16, the gaseous propulsion pressure in the chamber 11 is simultaneously transmitted at least partially through the throttle opening or openings 13 into the chamber 12 whence it propagates in the space 14 between the two tubular members 16 and 10, thereby compressing the second spacer members 17' and passing a compression wave along and around the inner tubular member 16. The wave travels toward the open end of the tubular member 16 at the same speed as the weapon 18. As the weapon passes the additional throttle openings 13' on its way out of the tubular member 16, these additional throttle openings 13' are opened and permit passage of the propulsion pressure at least partially into the space between the two tubular members. The throttle openings 13, 13' may be so-constructed that their cross-sectional flow passage becomes larger with the lapse of time. This may, for example, be accomplished by burning off the edge around the throttle openings. The propellant gas may do the burning so that with the passage of time the quantity of compressed propellant gas passing through the throttle openings increases, whereby the flow quantity corresponds to the accelerated travel of the weapon 18. In this connection it is also possible to achieve the same function by increasing the number of throttle openings from the closed to the open end of the launcher. Similarly, the diameter of the throttle openings may get larger from the closed to the open end of the launcher.

In the preferred embodiment shown in FIG. 1, a plastically deformable sleeve 15 is inserted between the first and second tubular members 16 and 10. The spacers 17 are located between the bottom 16' and the bottom 15' of the plastically deformable sleeve 15. Thus, the spacers 17 are located in the space 12. On the other hand, the spacers 17' are located in the space 14 between the inner wall of the outer second tubular member 10 and the outwardly facing surface of the sleeve 15. The sleeve 15 is made of a material having a sufficient ductility so that it may be plastically expanded by the compressive wave caused by the explosion of a propellant charge in the space 11, whereby a portion of the explosive force passes through the throttling openings 13 to thereby cause the expansion of the sleeve 15, thereby forming a bulging ring portion 15'' which is progressively pushed away from the first tubular member 16 against the inner wall of the second tubular member 10 or against the compressible spacers 17', whereby the bulging ring portion 15'' travels along the length of the first tubular member 16 around the outside thereof to provide the protective dynamic supporting stress. The material of which the plastically deformable sleeve 15 is made must have such a ductility that it will not rip in response to the compressive wave caused by the explosion. Materials suitable for this purpose are, for example, copper or mild steel.

The width of the space 12 which is preferably a space enclosed by two curved surfaces such as the bottom 16' and the bottom 10', is maintained as narrow as possible in order to keep the weight of the structure as low as possible. Incidentally, the spacers 17' have a sufficient rigidity, in addition to their being compressible, to properly locate the inner tubular member 16 inside the outer tubular member 10. The spacers 17 on the other hand, must be rigid for the transmission of any recoil force from the inner tubular member to the outer tubular member as mentioned. Further, it is to be understood that the use of a plastically deformable sleeve 15 is not limited to a structure such as shown in FIG. 1. Rather, where a plurality of tubular members are arranged coaxially relative to each other such a plastically deformable sleeve may be located in each ring space.

Calculations which have been made with regard to the embodiment of FIG. 1 and intended to calculate the savings in weight while nevertheless providing the required strength for the double shell launcher of FIG. 1, have shown, that the temporary strength is assured, even though the mass or weight of the structure has been reduced. These calculations indicate that a temporary increase in the structural strength of 25% nevertheless permitted a reduction of 41% in the weight of the structure. Compared to the prior art this result is significant because in prior art methods for increasing the permissible internal pressure a temporary increase in the structural strength is available only to a very limited extent, if at all. For example, in connection with fiber reinforced materials it is hardly possible to maintain the mentioned "eigen"-stress for prolonged periods of time and at the desired high values.

Figure 2:
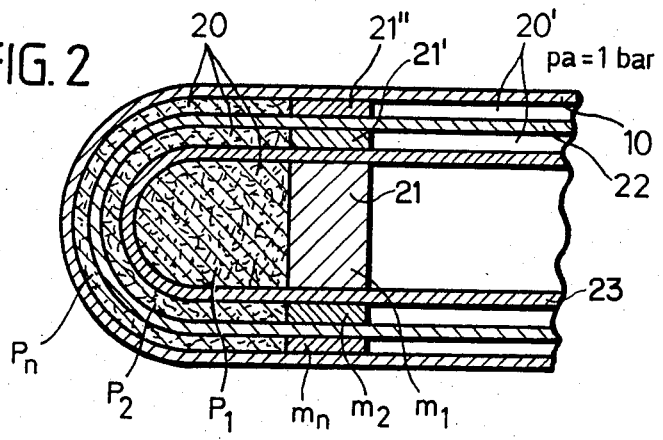
FIG. 2 is a sectional view similar to that of FIG. 1, however, showing a modification with several external tubular members arranged concentrically relative to each other and relative to the main or first launching tubular member.

FIG. 2 illustrates an embodiment employing a plurality of tubular members arranged coaxially with the high pressure launching tube 23. Thus, the external tubular member or shell 10 surrounds an intermediate tubular member or shell 22 which in turn surrounds the inner tubular member 23 forming a throw-away type of launcher for the acceleration or launching of throw-type or grenade type projectiles. This launcher is constructed for a one-time use and the spaces 20, as well as the explosive charges in the spaces 20 are so-dimensioned that a stepwise pressure reduction takes place from the inside out. Stated differently, the pressure P1 inside the inner tubular member 23 within the space determined by the stopper 21 having a mass m1, is larger than the pressure P2 inside the space determined by the two tubular members 22 and 23 and the ring stopper 21' having a mass m2. The pressure $P_n$ in the space determined by the intermediate tube member 22, by the outer tubular member 10, and by the stopper 21'' having a mass mn, is smaller than the pressure P2 and so forth if more than three tubular members should be used. This pressure reduction from the inside out is accomplished by correspondingly dimensioned explosive charges. Further, the volume of the spaces 20 may be varied by manually displacing the tubular members relative to each other in the axial direction. The masses of the stoppers 21, 21', and 21'' are so dimensioned in relation to the explosive charges that all stopper masses will receive the same acceleration so that they travel in synchronism along the length of the tubular members and reach the open end at the same time, whereby the desired strengthening of the inner tubular member 23 is achieved. The respective charges in the spaces 20 are ignited simultaneously. The means for such simultaneous ignition are conventional and hence not described.

Figure 3:
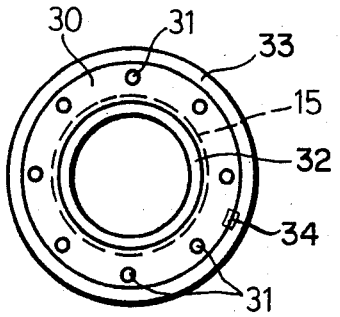
FIG. 3 shows an end view into the barrel of an artillery piece equipped according to the invention.

FIG. 3 illustrates the application of the present teaching to an artillery barrel comprising an inner tubular member 32 surrounded by an outer tubular member 33, wherein the ring opening between the two tubular members is closed by a closure 30 which preferably forms a flap hinged to one of the tubular members by a hinge 34. The hinge 34 itself is conventional and is preferably a spring biased hinge which will keep the flap 30 in the closed position with a predetermined force. The structure of the tubular members may, for example, be the same as shown in FIG. 1 and including a plastically deformable sleeve 15 also shown in FIG. 3. The flap or closure 30 is provided with jet openings 31 for providing a predetermined pressure in the spaces 12, 14 inside the artillery barrel. The teaching of the invention is applicable to structures which are not necessarily of a shape having a rotational symmetry as shown in FIGS. 1, 2 and 3. Thus, the present teaching may, for example, be employed in connection with combustion chambers having, for instance, a square cross-sectional shape, whereby the surrounding chambers would have the same shape. Thus, the difficulties heretofore encountered in applying reinforcing winding layers of fiber reinforced materials externally to a combustion chamber are obviated by the present teaching. Such reinforcing windings around chambers not having a rotational symmetry caused difficulties heretofore because the reinforcing windings did not have the desired dimensional or shape stability.

The temporary or dynamic type reinforcing according to the invention may also be achieved by applying to the external surface of a throw-away launching tube an explosive charge which is capable of progressively igniting or combusting along the length of the tubular member in synchronism with the travel of the weapon out of the launcher. Such an external explosive charge would again be ignited simultaneously with the propellant. The acceleration or speed of the external explosive charge combustion would be the same as the acceleration or speed of the weapon being discharged out of the launcher.

The invention has, among others, the advantage that relaxation problems have been entirely eliminated because the operational stress and the counteracting supporting stress occur simultaneously and cease substantially simultaneously. There are also no problems with the proper direction of the biasing stress applied heretofore because, according to the invention, no such biasing stress is involved. Furthermore, biasing load limitations which in the prior art have been dependent on the tensile and compression strength limitations or on the structural shape of the components involved, have been eliminated according to the invention.

Yet another advantage of the invention is seen in that due to the simultaneous application of the operational load or stress and the counter- or supporting-stress, it is now possible to employ higher operational loads. This applies particularly in those instances in which the size of the permissible pre-loading or biasing was determined heretofore by the static material strength of the structural component involved, for example, in tubular members wound of fiber compound materials in which the compression strength of the material is reached in the inner launching tube. The biasing stress could not be larger than the compression strength.

It is now also possible to dimension launchers intended for a single use in accordance with the temporary strength achieved by the simultaneous application of the operational and counter-stress, whereby again higher operational stress may be handled than was possible heretofore due to the dynamic type of support accomplished by the invention.

Moreover, it is now possible to standardize the supporting tubular members for taking up the dynamic support forces, whereby costs are reduced.

Although the invention has been described with reference to specific example embodiments, it will now be appreciated that it is intended to cover all modifications and equivalents within the scope of the appended claims.

What is claimed is:

1. An apparatus for dynamically supporting a high stress structure, comprising a first tubular member having a closed end and an open end for forming said high stress structure, second tubular means operatively surrounding said first tubular member for enclosing a space around said first tubular member, first explosive charge means in said first tubular member for generating an operating stress inside said first tubular member, said second explosive charge means for simultaneously providing a protective dynamic supporting stress inside said space for at least partially counteracting said operating stress, wherein said second tubular means comprise at least one second tubular member also having a closed end and an open end arranged concentrically relative to said first tubular member so that said closed ends face each other, said apparatus further comprising at least one spacer ring member between adjacent tubular members for permitting a manual axial displacement of said second tubular member relative to said first tubular member for varying a volume enclosed by said closed ends of said first and second tubular members and by said spacer ring member, whereby said second explosive charge is dimensioned by said volume.

2. The apparatus of claim 1, wherein said second explosive charge means and the mass of said spacer members are so dimensioned relative to each other that all spacer members receive the same acceleration by an explosive force caused by said second explosive charge means, whereby said spacer members travel in synchronism with each other and with a further explosive force caused by said first explosive charge means in said first tubular member, along the length of said tubular members.

* * * * *